US007743703B2

(12) United States Patent
Ameshofer

(10) Patent No.: US 7,743,703 B2
(45) Date of Patent: Jun. 29, 2010

(54) SELF-INKING STAMP WITH INTERNAL SNAP-IN ELEMENT

(75) Inventor: Manfred Ameshofer, Peuerbach (AT)

(73) Assignee: Colop Stempelerzeugung Skopek Gesellschaft m.b.H. & Co. KG, Wels (AU)

( * ) Notice: Subject to any disclaimer, the term of this patent is extended or adjusted under 35 U.S.C. 154(b) by 569 days.

(21) Appl. No.: 11/794,999

(22) PCT Filed: Jan. 18, 2006

(86) PCT No.: PCT/AT2006/000027

§ 371 (c)(1),
(2), (4) Date: Jul. 10, 2007

(87) PCT Pub. No.: WO2006/079131

PCT Pub. Date: Aug. 3, 2006

(65) Prior Publication Data

US 2008/0000369 A1 Jan. 3, 2008

(30) Foreign Application Priority Data

Jan. 25, 2005 (AT) ..... A 106/2005

(51) Int. Cl.
*B41K 1/40* (2006.01)

(52) U.S. Cl. ..... 101/405; 101/104; 101/333; 101/334

(58) Field of Classification Search ..... 101/334, 101/405

See application file for complete search history.

(56) References Cited

U.S. PATENT DOCUMENTS 1,401,436 A 12/1921 Pannier
2,079,080 A * 5/1937 Melind ..... 101/334
4,432,281 A 2/1984 Wall et al.
4,823,696 A 4/1989 Skopek (Continued)

FOREIGN PATENT DOCUMENTS

AT 383993 B 9/1987

(Continued)

OTHER PUBLICATIONS

International Search Report.

*Primary Examiner*—Jill E Culler
(74) *Attorney, Agent, or Firm*—Collard & Roe, P.C.

(57) ABSTRACT

A self-inking stamp with a stamp housing (4) in which a stamp type unit (3), which is coupled to an actuating bow (5) that is displaceable relative to the stamp housing (4), is mounted so as to be displaceable and at the same time to be pivotable by 180°, and with a handle (21) connected to the actuating bow (5) by snap-in engagement, which handle is designed as a hollow body (21') having a cover (84), the hollow body (21') having an inner tubular member (82) which, when the actuating bow is actuated against the force of a spring (18), is displaceable along a tubular member (19) connected to the stamp housing (4); a projecting hollow extension (70) is provided on the actuating bow (5), which extension (70), in the mounted position, extends into the hollow body (21) of the handle and guides the tubular member (19) connected to the stamp housing (4), and which has at least one snap-in element (73) which is engaged with a corresponding snap-in element (79) on the inner tubular member (82) of the handle (21).

12 Claims, 8 Drawing Sheets

U.S. PATENT DOCUMENTS

| | | | | |
|---|---|---|---|---|
| 5,058,501 | A | 10/1991 | Skopek | |
| 5,111,745 | A * | 5/1992 | Wilson | 101/405 |
| 5,850,787 | A | 12/1998 | Pichler | |
| 6,067,905 | A * | 5/2000 | Faber | 101/104 |
| 6,453,813 | B1 * | 9/2002 | Faber | 101/405 |

FOREIGN PATENT DOCUMENTS

| | | |
|---|---|---|
| WO | WO 90/02657 A | 3/1990 |
| WO | WO 96/16816 A | 6/1996 |

* cited by examiner

SELF-INKING STAMP WITH INTERNAL SNAP-IN ELEMENT

CROSS REFERENCE TO RELATED APPLICATIONS

Applicant claims priority under 35 U.S.C. §119 of Austrian Application No. A 106/2005 filed Jan. 25, 2005. Applicant also claims priority under 35 U.S.C. §365 of PCT/AT2006/000027 filed Jan. 18, 2006. The international application under PCT article 21(2) was not published in English.

BACKGROUND OF THE INVENTION

1. Field of the Invention

The invention relates to a self-inking stamp with a stamp housing, in which a stamp type unit, which is coupled to an actuating bow that is adjustable relative to the stamp housing, is mounted so as to be displaceable and at the same time pivotable by 180°, and with a handle connected to the actuating bow by snap-in engagement, said handle being configured as a hollow body with a cover, the hollow body having an inner tubular member which is displaceable during actuation of the actuating bow against the force of a spring along a tubular part that is connected to the stamp housing.

2. Description of the Related Art

From WO 90/02657 A, a self-inking stamp of the aforementioned type is known in which the stamp handle is connected to an actuating bow either by means of screws or by means of snap-in hooks. The handle itself is designed as a hollow body, wherein a tubular element is formed in its interior as a guiding sleeve, into which a sleeve or tubular part mounted on the stamp housing can be pushed telescopically, if the actuating bow including the handle, on the one hand, and the stamp housing, on the other hand, are displaced relative to each other during use of the stamp. Within the tubular or sleeve elements, a spring is arranged which presses the two components apart, i.e. the actuating bow with the handle, on the one hand, and the stamp housing, on the other hand, in order to keep the actuating bow in a non-operative position or resting position relative to the stamp housing. In case of the snap-in connection of the handle with the actuating bow, the snap-in hooks of the handle are mounted on the lower side thereof and inserted through holes in the upper transverse part or web of the actuating bow, being snapped in behind the opening rim. This snap-in connection, however, is comparatively unsafe, since the snap-in hooks become worn and broken off on account of the lever effect during multiple actuation of the stamp. Therefore, this snap-in engagement has not really been widely accepted in practice, and in most instances fastening by screw or fastening under plastic deformation of a passed-through pin has been provided. However, what is disadvantageous here is the increased expenditures during mounting and, moreover, those parts of the handle which are passed through the openings in the actuating bow and which project on the lower or inner side thereof are considered as objectionable and unattractive.

A self-inking stamp of different construction, even though also with a snap-in connection in the region of the actuating bow, is disclosed in WO 96/16816 A. In detail, an outer frame of synthetic material is arranged above the metal actuating bow, the legs of the synthetic material frame together with the legs of the actuating bow delimiting receiving spaces for helical springs which rest against a bottom wall of a receiving frame associated with the stamp housing. The actuating bow and the synthetic material frame outwardly surrounding it are interconnected by means of a separate pin which is put through an opening in the web of the actuating bow and snaps in with a handle knob formed within the synthetic material frame, integrally with the latter. This stamp construction, thus, is rather complex and expensive as regards the production of the individual parts as well as their assembling.

SUMMARY OF THE INVENTION

The invention now has as an object to remedy this situation and to provide a self-inking stamp with snap-in engagement between the handle and the actuating bow, wherein a safe connection of the handle with the actuating bow is achieved, on the one hand, and an easy release of the handle in case of need is enabled, on the other hand, and wherein furthermore the appearance of the stamp is not negatively affected by projecting snap-in and fastening members provided on the actuating bow.

To achieve this object, the invention provides for a self-inking stamp as discussed below. Particularly advantageous embodiments and further developments are as discussed below.

With the technique according to the invention, the position of the snap-in engagement of the handle with the actuating bow is moved from directly on the transverse part of the actuating bow into the interior of the handle so that, due to the short lever length, a low load is exerted on the site of connection when the stamp is actuated. Furthermore, in the interior of the handle, the snap-in connection elements can be made comparatively solidly, and therefore the snap-in connection may have a long useful life and overcome many stamp actuations without being damaged. Moreover, it is advantageous that the snap-in elements are hidden in the interior of the handle so that the appearance of the stamp is not negatively affected by any projecting parts on the actuating bow. Nevertheless, access to the snap-in elements is easily possible if the cover is removed from the handle. Usually, this cover is snapped onto the remaining handle body. If an access to the snap-in elements in the interior of the handle is made possible by removal of the cover, the interengaging snap-in elements can also be readily released from each other so that the handle can be removed from the actuating member of the hand stamp without any problems. This may be used for an optional exchange of the handle, e.g. if a different handle is desired, for instance a handle having a soft outer handle coating, a larger handle, or a basically differently shaped handle, e.g. a more cylindrical handle instead of a rather button-shaped handle.

The hollow extension provided on the actuating bow and projecting therefrom, preferably is of tubular design, yet in case of a self-inking stamp with actuation of the type unit, it may receive the helical compression spring in continuation of the tubular member on the stamp housing in order to optimally guide the tubular or sleeve member projecting upward from the stamp housing, if the actuating bow and the stamp housing are moved relative to each other, said helical compression spring being provided for pressing the actuating bow away from the stamp housing. The extension may also be closed by an—optionally perforated—wall provided on its upper end that faces away from the stamp housing, so that the spring can rest against the inner side of this wall.

As snap-in element, the extension may as such have a snap-in depression in which a snap-in projection on the inner tubular member of the handle snaps in. A simple snap-in projection may be provided as snap-in element on the extension. For a stable snap-in connection which, nevertheless, is readily releasable, however, at least one resiliently deflectable snap-in tongue is advantageously provided on the extension as said snap-in element. The snap-in tongue may be integrally formed with the extension, wherein on its upper end that faces away from the stamp housing, it is fixedly connected to the extension, whereas its lower, clear end that faces the stamp housing forms a radially outwardly projecting snap-in projection. In this manner, a particularly stable connection of the handle with the actuating bow is ensured, in which also a particularly high resistance to an unintended removal of the handle from the actuating bow is rendered possible.

The snap-in projection may have a chamfer on its side facing away from the engagement surface so as to gradually resiliently press inwards the snap-in tongue over said chamfered surface when the handle is pushed on the extension until the snap-in projection snaps back behind the rim of the tubular member. In its mounted state, the snap-in projection will then, e.g., abut on a snap-in surface of the inner tubular member of the handle, which snap-in surface faces away from the stamp housing, it further being provided that the snap-in surface of the tubular member is formed by a rim of a snap-in niche or snap-in recess in the tubular member. Thereinstead, it would, however, also be conceivable for the tubular member to simply end in the region of the snap-in tongue so that the upper rim of the tubular member forms the snap-in surface as counter-piece to the snap-in tongue with snap-in projection on the extension. However, by the fact that the tubular member continues to beyond the extension and has, e.g., two snap-in niches or snap-in recesses for preferably two diametrically oppositely arranged snap-in elements or snap-in tongues, an increased stability of the structure is attained. A particularly stable, firm embodiment is furthermore enabled if the tubular member is closed by a front wall provided on its upper side facing away from the stamp housing. In the mounted position, this front wall may contact the wall closing the extension. If, however, such a closing wall is not provided, the front wall of the tubular member may at least contact the front side of the tubular extension. In this case, the front wall of the tubular member may form the resting surface for the inwardly provided helical compression spring.

The components that carry snap-in elements, i.e. in particular the extension, or the actuating bow carrying the extension, respectively, just as the hollow body of the handle, preferably are made of a synthetic material, such as, in particular, acrylonitrile-butadiene-styrene copolymer (ABS) or polyoxymethylene (POM).

As has already been mentioned, preferably two diametrically oppositely arranged snap-in elements are provided on the extension, on the one hand, and particularly in the form of rims of snap-in windows or niches on the inner tubular member, on the other hand.

For reasons of production, on the one hand, as well as for reasons of strength, on the other hand, it is, finally, particularly advantageous if the actuating bow is provided in two parts, an inner bow part made of a synthetic material forming a seat for an outer bow part made of metal, the outer bow part made of metal having a passage opening provided in its web which interconnects the bow legs, for passage of the extension which is connected to the inner bow part, preferably integrally connected.

BRIEF DESCRIPTION OF THE DRAWINGS

In the following, the invention will be explained in more detail by way of particularly preferred exemplary embodiments to which, however, it shall not be restricted, and with reference to the drawing. In the drawing, in detail.

DETAILED DESCRIPTION OF THE PREFFERRED EMBODIMENTS

Figure 1:
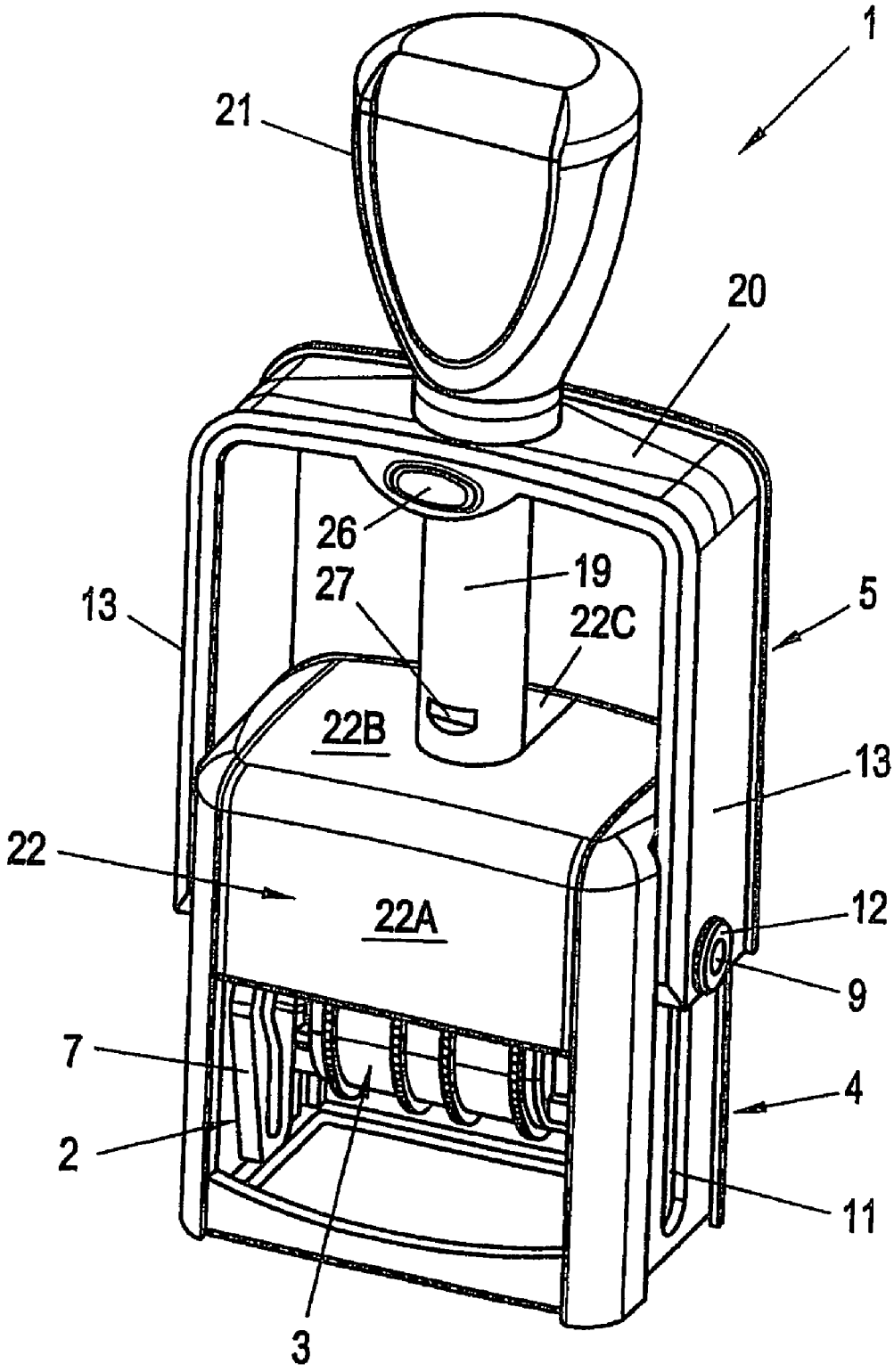
FIGS. 1 and 2 are perspective views of a self-inking stamp with a stamp unit comprising several type bands, viewed from two different sides.

In FIGS. 1 to 4, a self-inking stamp 1 with upper inking having a per se common basic construction and function is illustrated by way of example, which comprises a turning mechanism 2 for a stamp type unit 3. With the help of an actuating bow 5, the type unit 3 is upwardly and downwardly movable in a stamp housing 4 formed of two parts 4A, 4B and, thus, starting from an upper resting position illustrated in FIGS. 1, 2 and 4, in which the stamp types (not visible in FIGS. 1 to 4, yet see FIG. 5) contact an ink pad soaked with stamping ink within a drawer-like container 6 that can be pushed into and out of the stamp housing 4, is movable by 180° into a lower, turned imprinting position. The construction of the turning mechanism 2 is known per se, cf. e.g. U.S. Pat. Nos. 1,401,436 or 4,432,281, and has rocker-shaped turning members 7 pivotably mounted at their upper ends, having a curved control slot 8 for a turning axle 9. In the assembled state, this turning axle 9 extends through a base member 10 of the type unit 3, cf. also FIG. 8 in addition to FIG. 4; furthermore, the turning axle 9 extends through longitudinal slots 11 or 11A, 11B, respectively (cf. FIG. 4) of the stamp housing 4, and it is fixed by means of bushing-type axle securing members 12 in legs 13 of the actuating bow 5. By means of pins 14, the turning members 7 are pivotably mounted in bores 15 (or 15A, 15B, respectively) of the stamp housing 4 and they carry inner pins 16 engaging in lateral guiding grooves 17 of the type unit 3 for turning the type unit 3 during its downward movement with the help of the bow 5 and the turning axle 9, cf. also FIG. 5.

Figure 2:
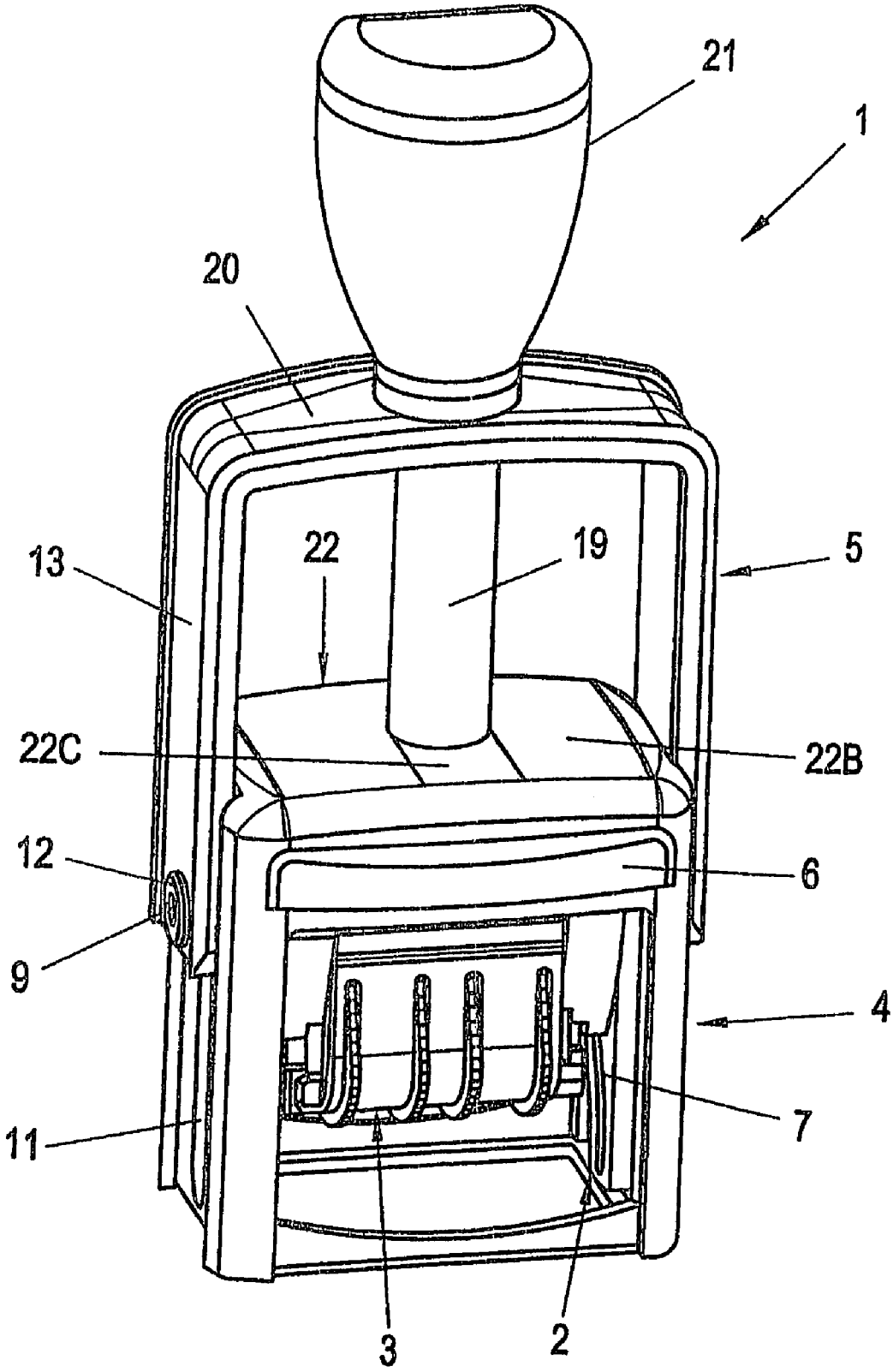
Figure 3:
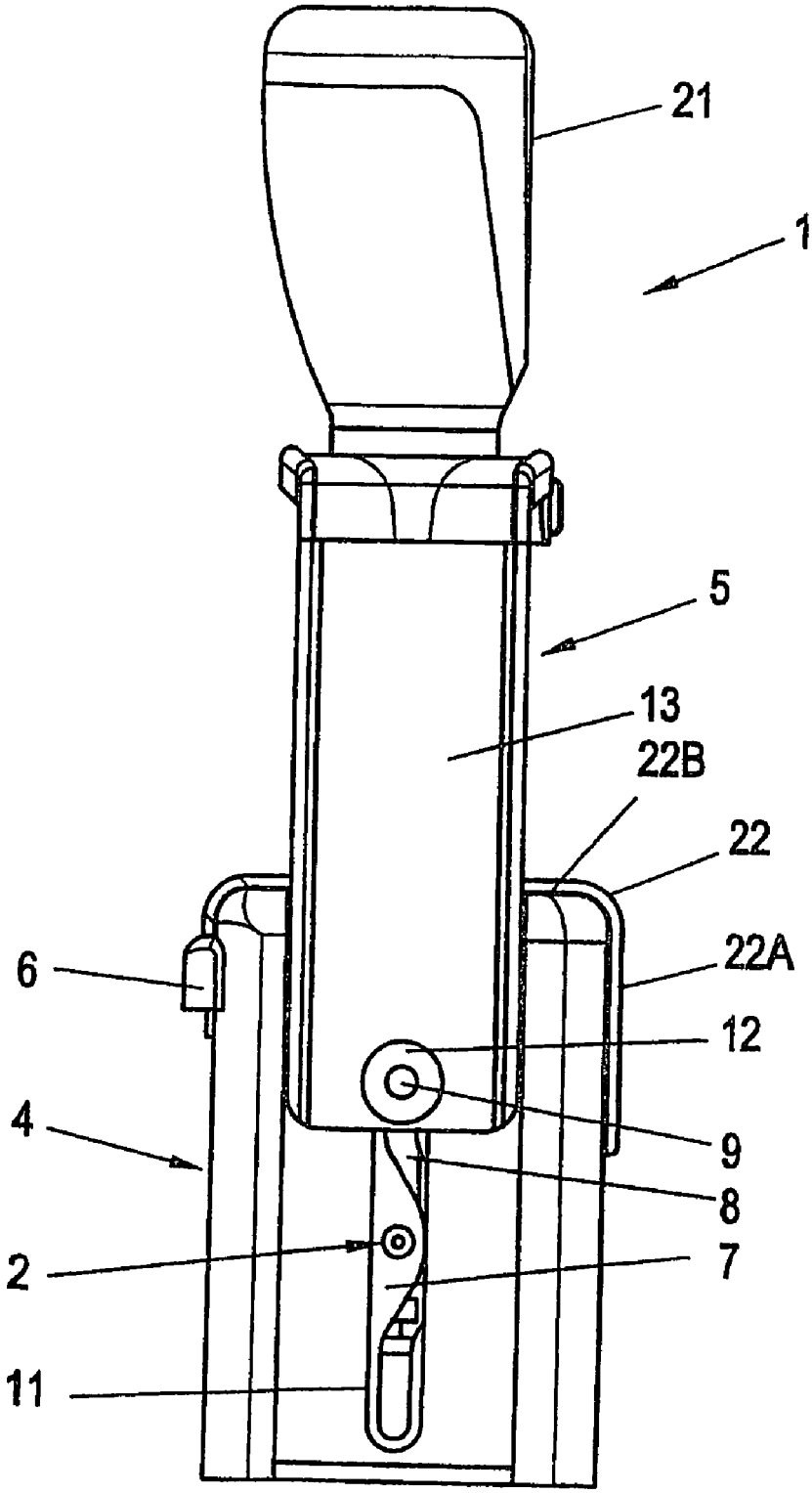
FIG. 3 is a side view of this self-inking stamp.

By means of a spring 18, in particular a helical compression spring supported on the upper side of the stamp housing 4, the actuating bow 5 is pressed in conventional manner into its upper resting position illustrated in FIGS. 1 to 3, and it is downwardly movable relative to the stamp housing 4 against the force of this spring 18. The spring 18 is accommodated in a tubular member 19 which extends into a handle 21 mounted on the upper side of the actuating bow 5, on the transverse part or web 20 thereof, the handle 21 and the tubular member 19 being telescopically moved within each other during actuation of the stamp 1. This, just like the snap-in connection arrangement for the handle 21, will be explained in more detail hereinafter by way of FIGS. 5 to 8.

Figure 4:
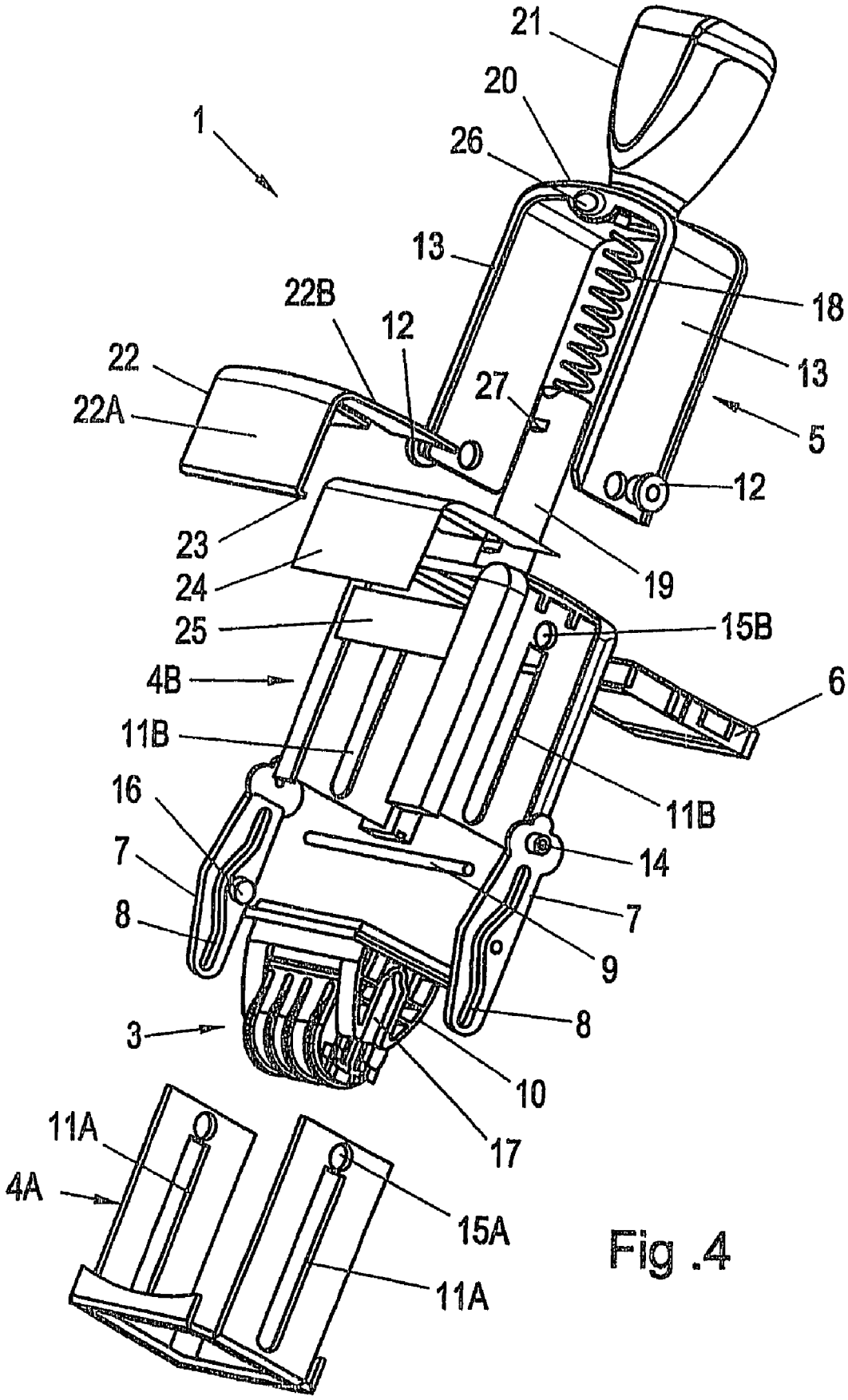
FIG. 4 shows the essential components of such a self-inking stamp in an explosion view.

On the stamp housing 4, furthermore, a text inspection window 22 of angular design with a comparatively large front area 22A and an upper cover area 22B is attached, a slot-shaped recess 22C being provided in said upper cover area 22B so as to be able to slip on the inspection window 22 during attachment on the stamp housing 4, in particular by snapping on with the help of a lower, inwardly projecting snap-in ledge 23 (cf. FIG. 4), despite the tubular member 19, said tubular member 19 being received in this recess 22C in its mounted position, as best visible in FIG. 2. In FIG. 4, moreover, a comparably angularly designed text card 24 having an upper, rear slot is visible, this text card 24 offering a comparatively large area for an imprint—on its front side as well as on its upper side—for applying appropriate information regarding the stamp imprint etc. When attaching it in the inspection window 22, the text card 24 may be inserted by putting it on the snap-in ledge 23 and fixing it together with the latter on the stamp housing upper part 4B by putting it on the upper side thereof as well as by snapping in the snap-in ledge 23 with a transverse web 25 of the stamp housing upper part 4B.

From FIG. 1, finally also a push-button snap-in means 26 provided on bow 5 is visible, which cooperates with notches 27 on the tubular member 19 so as to enable fixing of the actuating bow 5 in the pre-determined position relative to the stamp housing 4, as is known per se.

Similarly to the stamp housing 4, also the actuating bow 5 is comprised of two members one slid over the other, i.e. an upper, or outer, respectively, metal bow part which is U-shaped in elevation, and a lower, or inner, respectively, bow part 5B made of synthetic material which not only has a seat 26' for the push button snap-in means 26 molded to its upper web portion 20B, but, moreover, has a tubular extension 70 on its upper side, which tubular extension is closed on its upper front side, i.e. at its upper end that faces away from the stamp housing 4, by a wall 71 having a central opening 72. This extension 70 is provided with two diametrically oppositely arranged snap-in elements 73 having the shape of snap-in tongues 74 each formed with an outwardly projecting snap-in projection 75 provided on its freely cantilevering lower end, cf. particularly FIG. 8 in addition to FIGS. 5 and 6.

Figure 5:
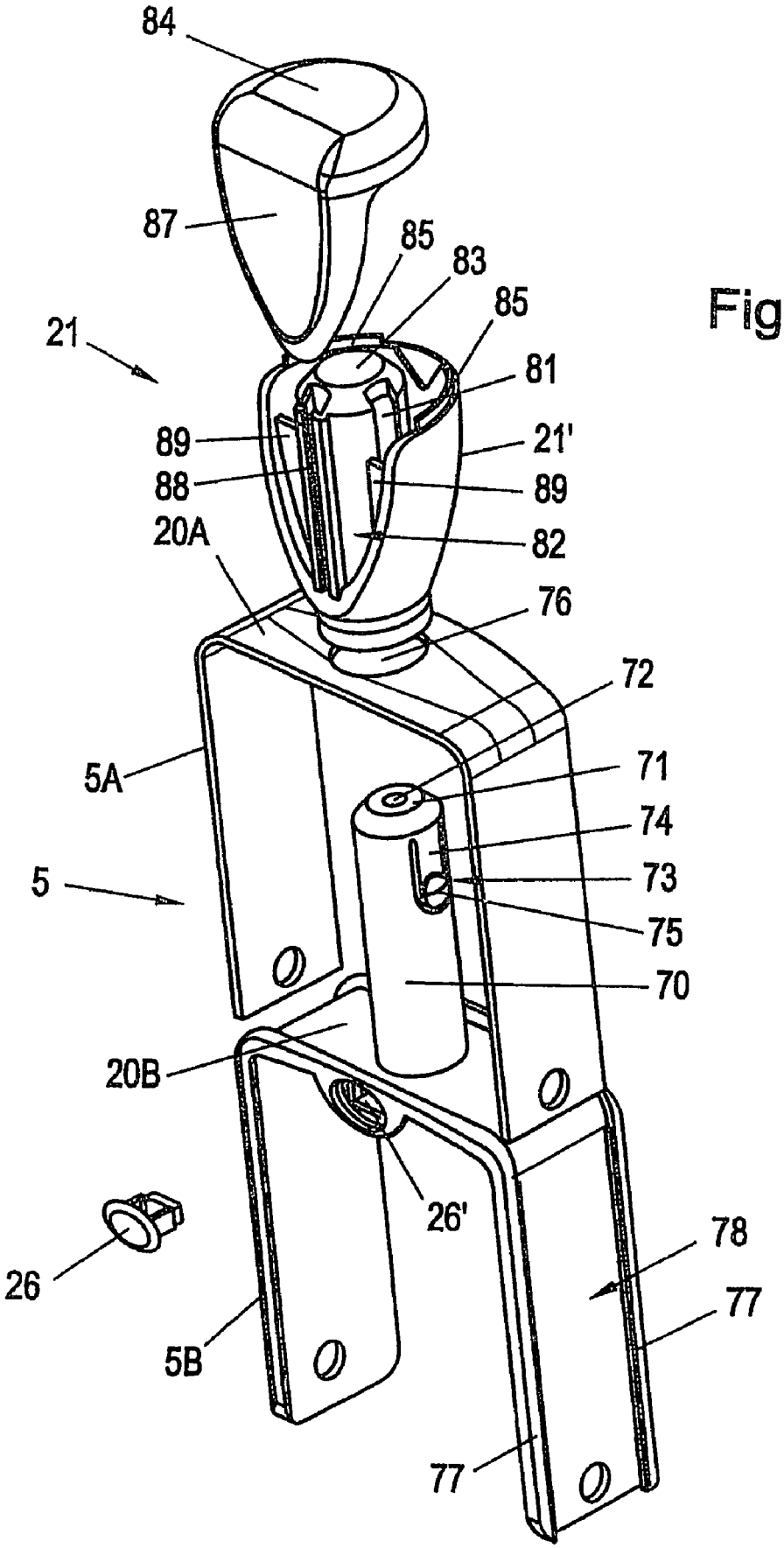
FIG. 5 shows a perspective, explosion view of the parts of a two-component actuating bow and a two-component handle of such a self-inking stamp.
Figure 6:
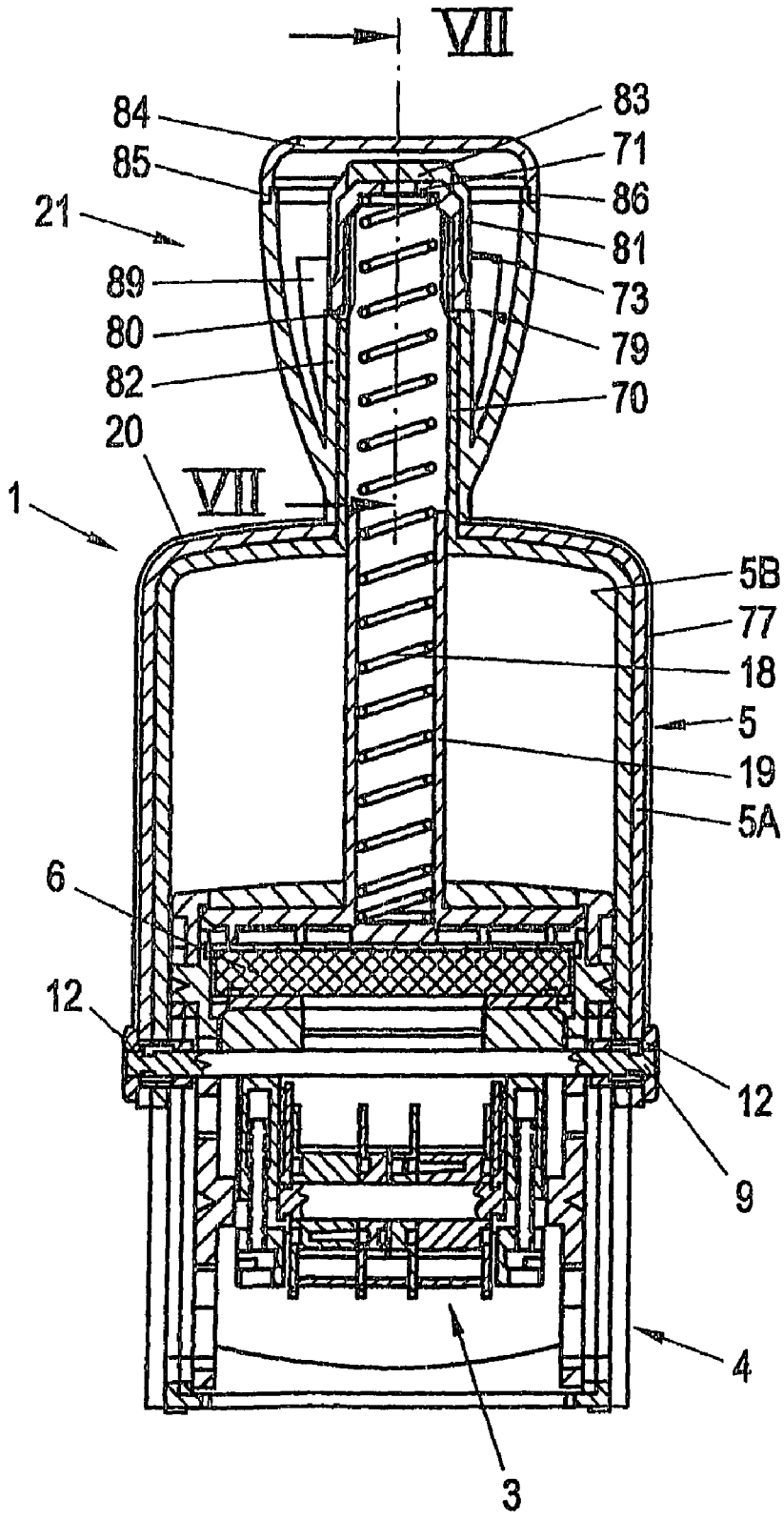
FIG. 6 shows a longitudinal section through the self-inking stamp according to FIGS. 1 to 4, with a two-component actuating bow according to FIG. 5.

In the assembled state of the actuating bow 5, i.e. when the metal upper part 5A of the actuating bow 5 has been slid onto the lower part 5B, the tubular extension 70 extends through an opening 76 in the upper web part 20A of the metal bow part 5A and into the interior of the handle 21 which is configured as a hollow body 21', cf. particularly FIG. 6 in addition to FIG. 5. On its front and rear sides, the lower bow part 5B made of synthetic material is provided with guiding ledges 77 embracing the upper metal bow part 5A, which guiding ledges ensure a seat 78 for a firm fit of the upper bow part 5A on the lower bow part 5B and, moreover, cover the sharp edges of the metal upper bow part 5A like a sheathing.

Figure 7:
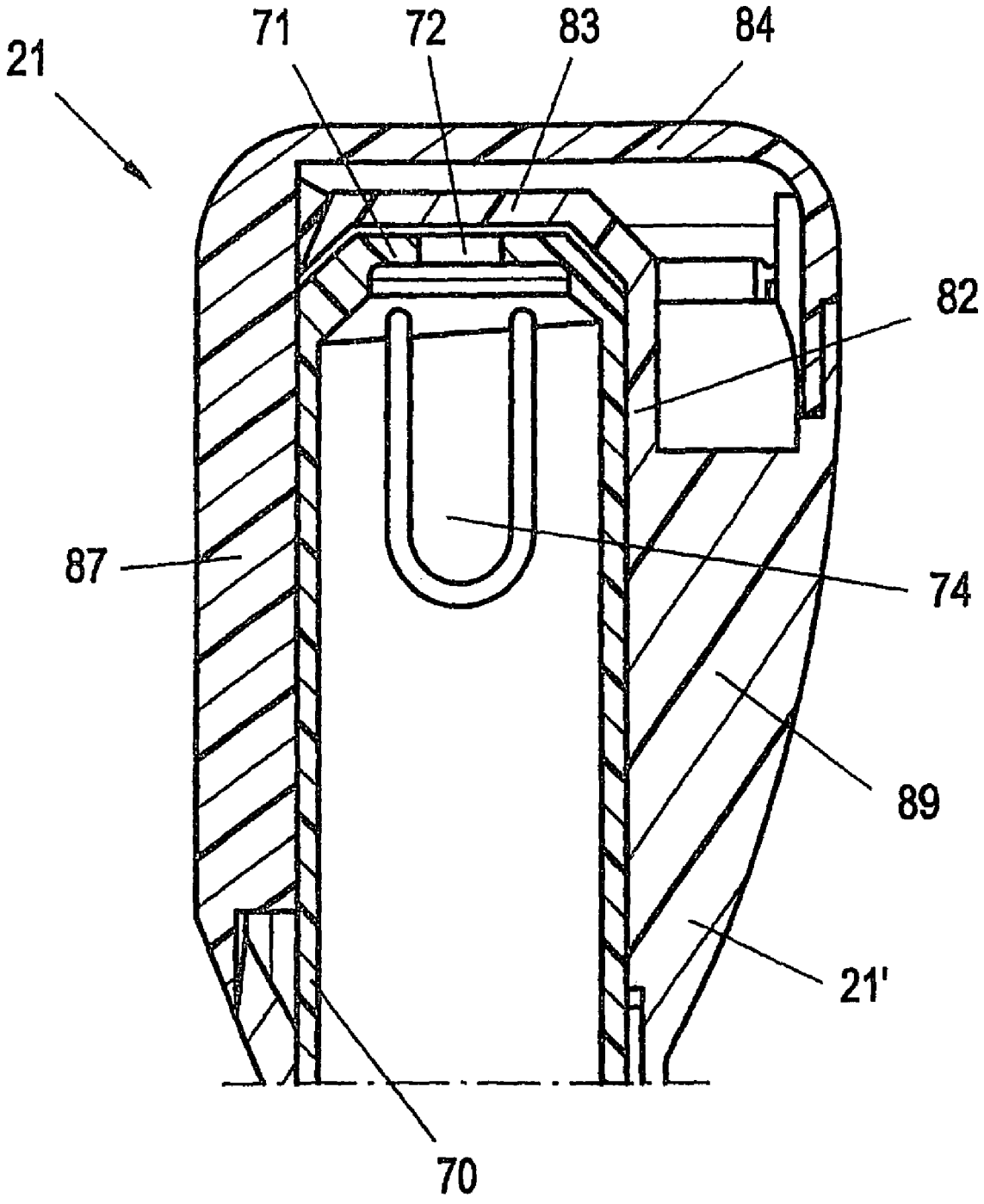
FIG. 7 shows a section through the handle of the stamp according to line VII-VII of FIG. 6.
Figure 8:
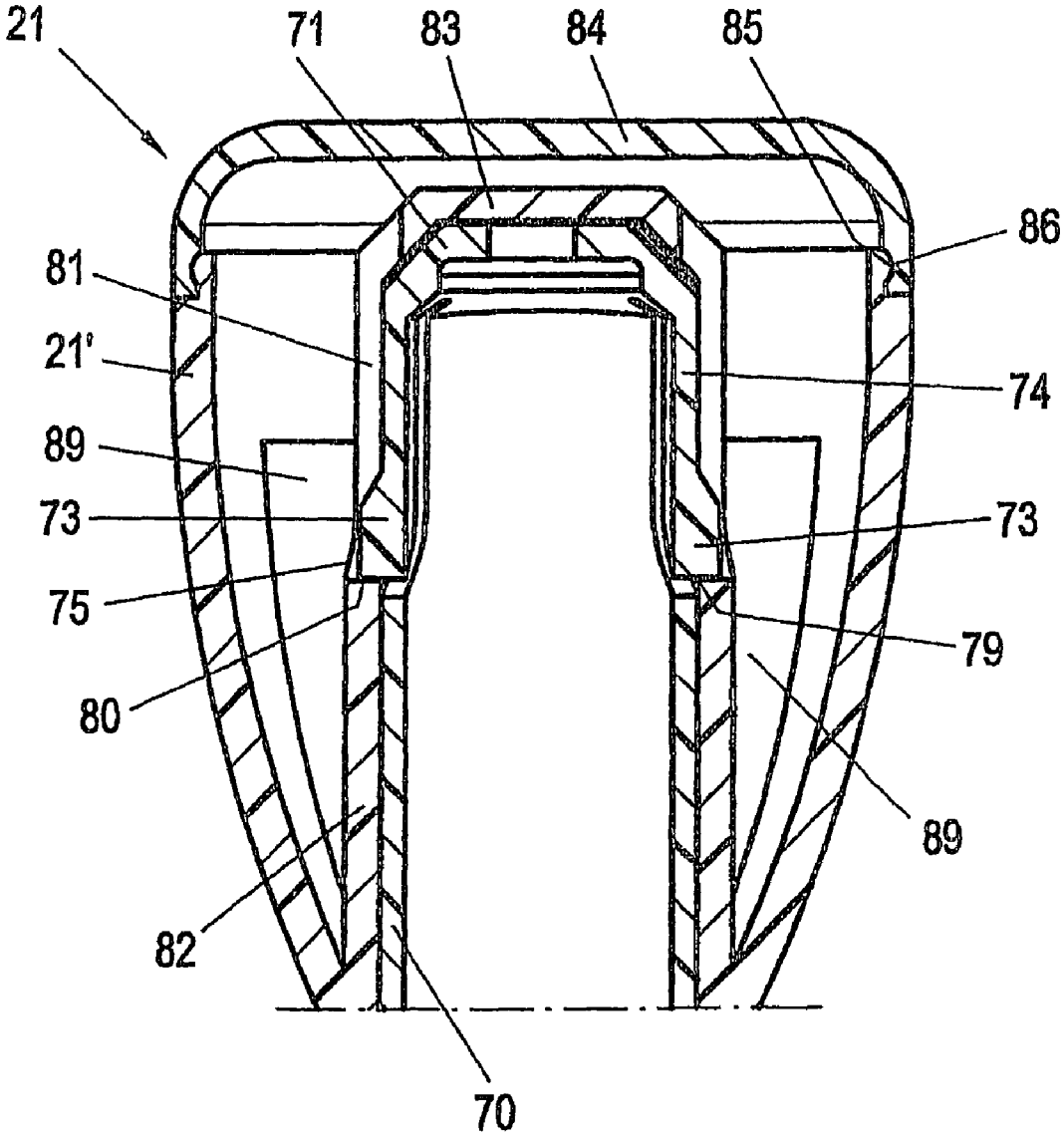
FIG. 8 shows a section through the upper part of the handle, similar to the sectional illustration of FIG. 6, yet on a scale somewhat enlarged relative to the former.

In the mounted position shown in FIG. 6 as well as in FIG. 7, the snap-in elements 73 on the extension 70 cooperate with corresponding snap-in elements 79 having the form of upwardly-facing snap-in surfaces 80 of the handle 21, these snap-in surfaces 80 being the rims of diametrically oppositely arranged snap-in niches or recesses 81 (cf. FIGS. 5 and 6) in an inner tubular member 82 of the handle 21. Furthermore, this tubular member 82 is closed by a front wall 83 on its side which, according to the illustration of FIGS. 5 to 8, is its upper side that faces away from the stamp housing 4. In its mounted state, as illustrated in FIGS. 6, 7 and 8, this front wall 83 rests on the upper wall 71 of the extension 70 and, thus, additionally stabilizes fastening of the handle.

As then is particularly visible from FIGS. 5 and 8, in addition to the handle hollow body 21' proper, the handle 21 has a cover 84 engageable therewith, snap-in ledges 85 provided on the upper front side of the hollow body 21', with an external, bead-shaped snap-in projection not further denoted in the drawing, snapping in in a manner known per se in a corresponding groove 86 provided in the wall of the cover 84. The cover 84 has a flat front side 87, cf. FIGS. 5 and 7, by means of which it is guided along the tubular member 82. To this end, a direct contact, as shown in FIG. 7, may be provided, yet also a per se conventional groove and tongue guide may be provided, a corresponding guiding groove 88 being visible on the tubular member 82 in FIG. 5. Such a tongue-and-groove guide including the guiding groove 88 facilitates putting on and snapping on of the cover 84 on the hollow body 21'. Nevertheless, the cover 84 may also be removed again from the hollow body 21' without any problems by pushing it upwards, whereby an access to the interior of the hollow body 21' of the handle and, thus, to the snap-in elements 73 is provided so that these snap-in elements 73 can be pressed radially inwards to release the snap-in engagement on the snapping-in rim surfaces 80 of the tubular member 82 and, thus, to enable taking the handle 21, or its hollow body 21', respectively, off the actuating bow 5. Even though an extremely stable snap-in connection is achieved between the handle 21 and the bow 5 by means of the snap-in connection elements described, the handle 21 can easily and comfortably be taken off in this manner and may, e.g., be exchanged for another handle, such as one having a different shape and/or surface.

As furthermore is visible from FIGS. 5 and 7, the tubular member 82 in the interior of the hollow body 21' of the handle may be connected to the latter via at least substantially radial stiffening webs 89 which, seen in top view, extend approximately in star shape. However, it is preferred to provide the two front webs 89 visible in FIG. 5 eccentrically and in parallel with the front side 87 of the cover 84.

The lower bow part 5B including the extension 70 preferably is integrally produced as an injection-molded member, just like the hollow body 21' of the handle including the inner tubular member 82, with acrylonitrile-butadiene-styrene copolymer (ABS) being used as the synthetic material, e.g., it, however, also being possible to use polyoxymethylene (POM) or a comparable synthetic material.

For supporting the spring 18 on the upper side, in the interior of the handle 21, it would, of course, also be conceivable to provide a web cross or the like instead of the upper wall 71, and of the front wall 83, respectively, additionally supporting the former. In principle, the front wall 83 may be omitted at all. The tubular part 82 could then be formed as a tube socket, the upper front side of which defines a circumferentially extending upper rim 80 as a snap-in element 79. In terms of their functioning, it is theoretically also conceivable to interchange the snap-in elements 73 and 79, i.e. to provide elastically deformable snap-in elements on the tubular member 82 and rigid snap-in surfaces cooperating with the former, or snap-in depressions on the extension 70. Furthermore, it is, of course, also possible to provide a single-part bow 5, in particular made of synthetic material, optionally also made of metal. The shape of the handle 21 may, e.g., also be cylindrical or spherical etc. in addition to the flattened frusto-conical shape shown.

The axle-securing members 12 may, e.g., be injection-molded of polyoxymehtylene (POM) or of a comparable, relatively hard, resiliently elastic synthetic material, and they mount the turning axle 9 rotatably in the actuating member, or actuating bow 5, respectively, wherein they secure the turning axle 9 against being unintentionally pushed out of the stamp 1 and, moreover, also retain the bow parts 5A and 5B relative to each other so that the ends of the bow parts 5A, 5B cannot be unintentionally straddled. On the upper side of the actuating bow 5, its parts 5A, 5B with its web portions 20A, 20B are held at each other by the handle 21, or more precisely, its hollow body 21', contacting by means of its lower side the metal web 20 when the hollow body has been snapped on with its tubular member 82 on the extension 70 of the synthetic material bow part 5B.

The invention claimed is:

1. A self-inking stamp with a stamp housing (4) in which a stamp type unit (3), which is coupled to an actuating bow (5) that is displaceable relative to the stamp housing (4), is mounted so as to be displaceable and at the same time pivotable by 180°, and with a handle (21) connected to the actuating bow (5) by snap-in engagement, which handle is designed as a hollow body (21') having a cover (84), the hollow body (21') having an inner tubular member (82) which, when the actuating bow is actuated against the force of a spring (18), is displaceable along a tubular member (19) connected to the stamp housing (4), wherein a projecting hollow extension (70) is provided on the actuating bow (5), which extension (70), in the mounted position, extends into the hollow body and guides the tubular member (19) connected to the stamp housing (4), and which has at least one snap-in element (73) which, in the mounted position, is engaged with a corresponding snap-in element (79) on the inner tubular member (82) of the handle (21).

2. The self-inking stamp according to claim 1, wherein the extension (70) is tubular.

3. The self-inking stamp according to claim 1, wherein the snap-in element (73) carries at least one resiliently deflectable snap-in tongue (74).

4. The self-inking stamp according to claim 3, wherein at its upper end facing away from the stamp housing (4), the snap-in tongue (74) is fixedly connected to the extension (70), whereas its lower, clear end forms a radially outwardly projecting snap-in projection (75).

5. The self-inking stamp according to claim 4, wherein in the mounted state, the snap-in projection (75) abuts on a snap-in surface (80) of the inner tubular member (82) of the handle (21), which snap-in surface (80) faces away from the stamp housing (4).

6. The self-inking stamp according to claim 5, wherein the snap-in surface (80) of the tubular member (82) is formed by a rim of a snap-in niche or recess (81).

7. The self-inking stamp according to claim 6, wherein the tubular member (80) is closed by a front wall (83) provided on its upper side facing away from the stamp housing (4).

8. The self-inking stamp according to claim 7, wherein, in the mounted state, the front wall (83) of the tubular member (82) abuts the front side of the extension (70).

9. The self-inking stamp according to claim 1, wherein the extension (70) is closed by a wall (71) on its upper end which faces away from the stamp housing (4).

10. The self-inking stamp according to claim 1, wherein the extension (70) and the hollow body are made of a synthetic material, e.g. ABS.

11. The self-inking stamp according to claim 1, wherein the actuating bow (5) is provided in two parts, an inner bow part (5B) made of a synthetic material forming a seat (78) for an outer bow part (5A) made of metal, the outer bow part (5A) made of metal having a passage opening (76) provided in its web (78), which interconnects the bow legs, for passage of the extension (70) which is connected to the inner bow part (5B), preferably integrally connected.

12. The self-inking stamp according to claim 1, wherein the hollow extension (70) has two oppositely arranged snap-in elements (73).

* * * * *

UNITED STATES PATENT AND TRADEMARK OFFICE

CERTIFICATE OF CORRECTION

PATENT NO. : 7,743,703 B2
APPLICATION NO. : 11/794999
DATED : June 29, 2010
INVENTOR(S) : Ameshofer It is certified that error appears in the above-identified patent and that said Letters Patent is hereby corrected as shown below:

On the cover page, Item [73], please change the country of the Assignee from "(AU)" to correctly read: --(AT)--.

Signed and Sealed this

Seventeenth Day of August, 2010

David J. Kappos

David J. Kappos
*Director of the United States Patent and Trademark Office*